US005307036A

United States Patent [19]

Turunen et al.

[11] Patent Number: 5,307,036

[45] Date of Patent: Apr. 26, 1994

[54] CERAMIC BAND-STOP FILTER

[75] Inventors: Aimo Turunen; Pauli Näppä, both of Oulu, Finland

[73] Assignee: Lk-Products Oy, Kempele, Finland

[21] Appl. No.: 861,080

[22] Filed: Mar. 31, 1992

Related U.S. Application Data

[63] Continuation-in-part of Ser. No. 532,018, Jun. 1, 1990, Pat. No. 5,103,197.

[30] Foreign Application Priority Data

| | | | |
|---|---|---|---|
| Jun. 9, 1989 | [FI] | Finland | 892855 |
| Jun. 9, 1989 | [FI] | Finland | 892856 |
| Apr. 12, 1991 | [FI] | Finland | 911797 |

[51] Int. Cl.[5] ..... H01P 1/205

[52] U.S. Cl. ..... 333/202; 333/206

[58] Field of Search ..... 333/202, 206, 207, 222, 333/212

[56] References Cited

U.S. PATENT DOCUMENTS

| | | | |
|---|---|---|---|
| 4,028,652 | 6/1977 | Wakino et al. | 333/202 |
| 4,255,729 | 3/1981 | Fukasawa et al. | 333/202 |
| 4,423,396 | 12/1983 | Makimoto et al. | 333/204 |
| 4,431,977 | 2/1984 | Sokola et al. | 333/206 |
| 4,559,508 | 12/1985 | Nishikawa et al. | 333/202 |
| 4,692,726 | 9/1987 | Green et al. | 333/206 |
| 4,703,291 | 10/1987 | Nishikawa et al. | 333/202 |
| 4,716,391 | 12/1987 | Moutrie et al. | 333/206 |
| 4,740,765 | 4/1988 | Ishikawa et al. | 333/206 |
| 4,742,562 | 5/1988 | Kommrusch | 455/78 |
| 4,761,624 | 8/1988 | Igarashi et al. | 333/206 |
| 4,800,347 | 1/1989 | Yorita et al. | 333/202 |
| 4,800,348 | 1/1989 | Rosar et al. | 333/202 |
| 4,821,006 | 4/1989 | Ishikawa et al. | 333/202 |
| 4,823,098 | 4/1989 | DeMuro et al. | 333/206 |
| 4,829,274 | 5/1989 | Green et al. | 333/202 |
| 4,879,533 | 11/1989 | de Muro et al. | 333/206 |
| 4,896,124 | 1/1990 | Schwent | 333/206 |
| 4,954,796 | 9/1990 | Green et al. | 333/206 |
| 4,965,537 | 10/1990 | Kommrusch | 333/207 X |
| 5,097,236 | 3/1992 | Wakino et al. | 333/175 |
| 5,103,197 | 4/1992 | Turunen et al. | 333/206 |
| 5,109,536 | 4/1992 | Kommrusch | 455/82 |

FOREIGN PATENT DOCUMENTS

| | | | |
|---|---|---|---|
| 0208424 | 1/1987 | European Pat. Off. . | |
| 0401839 | 12/1990 | European Pat. Off. | 333/206 |
| 114503 | 7/1983 | Japan . | |
| 216601 | 10/1985 | Japan . | |
| 101902 | 6/1986 | Japan . | |
| 161806 | 7/1986 | Japan . | |
| 120703 | 6/1987 | Japan . | |
| 311801 | 12/1988 | Japan . | |
| 0312701 | 12/1988 | Japan | 333/202 |
| 66-0006 | 3/1989 | Japan . | |
| 53601 | 3/1989 | Japan . | |
| 2184608 | 6/1987 | United Kingdom . | |
| 2234398 | 1/1991 | United Kingdom . | |
| 2234399 | 1/1991 | United Kingdom . | |
| 2236432 | 4/1991 | United Kingdom . | |

OTHER PUBLICATIONS

Matthaei et al., *Microwave Filters, Impedance—Mathing Networks and Coupling Structures,* McGraw-Hill, pp. 497-506 & 733-737 (1964).

(List continued on next page.)

*Primary Examiner*—Seungsook Ham
*Attorney, Agent, or Firm*—Darby & Darby

[57] ABSTRACT

In order to provide a sufficient isolation between the resonators of a band-stop filter, prior art band-stop filters must be manufactured from separate ceramic resonator blocks. According to the invention the band-stop filter can be manufactured in a single ceramic block (1), having on one side surface strip-like areas (14; 15) of electrically conducting material extending perpendicularly from the bottom edge to the top edge and being located in the area between the resonators (A and B, B and C) and having dimensions selected so that they substantially cancel the electric and magnetic field between the resonators. If necessary, the coupling between the resonators can be adjusted by changing the width of the strip-like areas (14; 15) or by providing them with discontinuities.

14 Claims, 2 Drawing Sheets

OTHER PUBLICATIONS

Nagle, *High Frequency Diversity Receiver From the 1930's,* Ham Radio, pp. 34–43 (Apr., 1990).

Patent Abstracts of Japan—vol. 14, No. 297, (E-945) Jun. 27, 1990 & JP-A-094 901 (Toko Inc.) Apr. 5, 1990.

Patent Abstracts of Japan—Vol. 7, No. 292 (E-219)(1437) Dec. 27, 1983 & JP-A-58-168 302 (Fujitsu K.K.) Oct. 4, 1983.

Patent Abstracts of Japan—vol. 5, No. 11 (E-42)(683) Jan. 23, 1981 & JP-A-55 141 802 (Alps Denki K.K.) Nov. 6, 1980.

Patent Abstracts of Japan—vol. 12, No. 106 (E-596)(2953) Apr. 6, 1988 & JP-A-62 235 801 (Fuji Electrochem Co. Ltd.) Oct. 16, 1987.

CERAMIC BAND-STOP FILTER

CROSS REFERENCE TO COPENDING APPLICATIONS

This application is a continuation-in-part of Ser. No. 07/532,018 filed Jun. 1, 1990, now U.S. Pat. No. 5,103,197 .

BACKGROUND OF THE INVENTION

This invention relates to a dielectric band-stop filter comprising two or more transmission line resonators of the coaxial type.

It is known that a ceramic resonator comprises a basic structure, where a hole is made in a ceramic block of a material with a high dielectric constant, e.g. titanate, the block having side surfaces, a top surface and a bottom surface, and the hole extending from the top surface to the bottom surface. The surfaces of the block are coated, except for the top surface, with an electrically conducting material. Circuit patterns are applied to the top surface, the circuits capacitively coupling a signal to the resonator and outputting the signal. The structure forms a transmission line resonator whose resonance frequency is determined by the length of the hole, i.e. by the thickness of the block. Usually the length of the hole is dimensioned so that a transmission line resonator of a quarter-wave length is obtained. When several holes are made in the block it is possible to realize a band-pass filter with several nodes, but the number of zeroes is limited to one, because it is difficult to isolate from the other resonators a resonator corresponding to a zero. Thus band-stop filters realized in ceramic technology became commercially available only recently. It is characteristic to all these known band-stop filters, that the filter is composed of separate resonators or of the basic structures described in the introduction, where a ceramic block contains a hole and where the block at least on the side and bottom surfaces is coated with conducting material. A desired number of these coated separate reasonator blocks are arranged in a row, whereby a band-stop filter is obtained with a desired bandwidth and center frequency. In a sense each resonator block forms a draining circuit, and these draining circuits are then coupled in a series through inductive or reactive circuits, connecting the upper ends of the resonators using e.g. a separate transmission line length. It is necessary to use separate resonators coated on the outside, because otherwise the mutual inductive and capacitive leaks between the resonators are difficult to control, i.e. in order to obtain sufficient isolation between the resonators. The isolation between the separate resonators is formed with the same coating, which forms an effective partition between the blocks.

A disadvantage of a band-stop filter assembled of separate resonators is that a filter made of many blocks requires a high production capacity, because every block is separately sintered and coated, and the blocks are electrically individually connected to each other, usually by soldering the connecting wires by hand. Further the separate blocks must be fastened to some mounting support in a mechanically reliable way.

In principle it would be possible to make a band-stop filter comprising several resonators in a single ceramic block. Then the distance between the resonator holes must be made very large, resulting in a very bulky filter.

This would increase material costs, and a big size is also otherwise inconvenient in portable radio equipment.

U.S. Pat. No. 4,823,098, Motorola, describes a monolithic ceramic filter with band-stop characteristics. The filter comprises 7 resonators located in the same ceramic block, of which three operate as a band-stop filter and the other as a band-pass filter. The resonators in the band-stop section are interconnected via quarter-wave transmission lines. The transmission lines invert the impedance of the resonators, so that the resonators generate zeroes in the filter. It is stated in the publication, that by sawing it is possible to separate said three filters from the block and to coat the new side wall obtained in the cutting with conducting material, whereby the obtained filter operates as an independent band-stop filter with several zeroes. It is not mentioned in the publication what influence the inductive coupling between the resonators, effected through the ceramics, has on the filter characteristic, but it seems probable that mutual coupling between the resonators makes it difficult to control the characteristics.

The Finnish patent applications FI-892855 and FI-892856, applicant LK-Products Oy, describe band-pass filters realized in a single ceramic block, where the basis of the inventive idea is that one side surface of the filter is substantially uncoated and that strip conductor patterns are applied on this side surface for connections to the transmission line resonators. When the circuit patterns are made on the side surface of the body, the filter input and output and the connections between the resonators can be made in a desired way, either purely capacitive or inductive, or as a combination of these.

SUMMARY OF THE INVENTION

The objective of this invention is to provide a band-stop filter which is realized in a single ceramic block containing several resonators, and where the mutual influence of the electric and magnetic fields between the resonators can be avoided without resorting to individual resonator blocks according to prior art. The invention is based on the development of the resonator circuits in the above mentioned FI-applications.

Unexpectedly it was found that by making in a suitable way a conducting area, a coating, between the resonator circuits on the uncoated side surface of the filter block, the electric and magnetic coupling between the resonators can be adjusted close to zero. When this conducting area is made in the form of a strip extending from the ceramic block bottom surface, where it is in contact with the conducting coating of the block, up to the upper surface of the side, an almost perfect electric and magnetic isolation is obtained between the resonators. The conducting areas according to the invention provide in a sense an electric "partition" between the resonators. If it is desired to make an "opening" in the partition, by which opening a coupling can be provided between the resonators, this can be made so that the conducting area is shortened or narrowed, or both. Depending on whether the shortening is made at the open end or at the short circuited end of the resonator, this will have an effect on either the capacitive or on the inductive coupling. When the conducting area is narrowed in the direction of the resonator it is possible to influence the strength of the coupling between the resonators. The individual resonators are mutually coupled through an inductive and/or a reactive coupling. Then it is possible to use the same principle as in the FI-applications 892856 and 892855, i.e. to use a circuit pattern located on the side of the filter and made with a mask. It is also possible to connect separate components, such as block capacitors and inductance wires to the circuit patterns. If the height of the the conducting area extends over the whole side wall, the connection from a resonator to the next resonator is made with an inductive wire, which jumps over the conducting area. Finally this whole side may be covered with a conducting cover.

BRIEF DESCRIPTION OF THE DRAWINGS

The invention is illustrated with reference to the enclosed figures, in which.

DESCRIPTION OF THE PREFERRED EMBODIMENT

Figure 1:
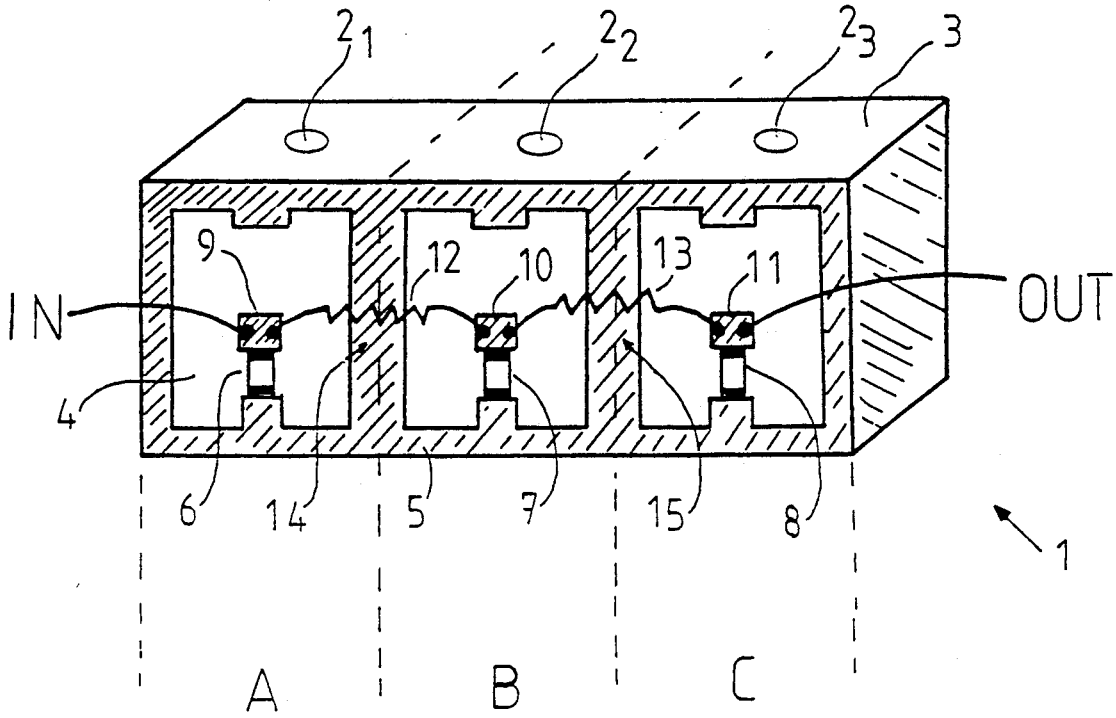
FIG. 1 shows a band-stop filter comprising three resonators.

The band-stop filter 1 according to the invention comprises three transmission line resonators A, B and C. A bar-like block of ceramic material is provided with holes $2_1$, $2_2$ and $2_3$ extending from the top surface 3 to the bottom surface of the block. The holes, the bottom surface, the ends, and one side of the block are coated with conducting material, e.g. with a silver-copper compound. The top surface 3 can also be coated, except for a narrow annular area around the upper edge of the holes $2_1$, $2_2$ and $2_3$. A circuit pattern 5 is applied with the aid of a mask on the uncoated side 4 of the block, the pattern circumventing as a strip also the edges of the side. With the mask also contact spots 9, 10 and 11 are applied to the side of each resonator. Conducting areas 14 and 15 according to the invention, located between the resonators, are made with the same mask, the areas extending from the block bottom edge, where they join the strip extending along the bottom edge of the side 4, to the top edge of the block, where they join the strip extending along the top edge of the block. The circuit pattern formed with the mask is shown with slanted lines in the figure. The end surface of the block, being one of the coated surfaces, is also shown with slanted lines. To the circuit pattern formed with the mask are connected the required components and wires for the connection of signals to the filter, for interconnection of the resonators, and for outputting the signal from the filter. The high frequency signal is input with wire IN to the connection spot 9 at the middle of resonator A. A block capacitor 6 is connected between this spot and the conducting strip at the bottom edge of the side. The signal is directed from resonator A via the connecting wire 12 to the second resonator B to the connection spot 10, which is also connected to the strip at the bottom edge of the side through a block capacitor 7. The connecting wire 12 represents a defined inductance. In a corresponding way the resonator B is connected to the resonator C with a wire 13 representing an inductance, and the connection spot 11 in connected to the strip at the bottom edge of the side through a block capacitor 8. The signal is then outputted from the spot 11 and out from the filter 1 along the conductor OUT. In order to have the circuit operating as a band-stop filter there must be no coupling through the dielectric material between resonators A, B and C, but the coupling must be effected only through the connecting wires 12 and 13. This is possible only in that the conducting areas 14 and 15 are located between the resonators in the way shown in the figure. It has been found that the dimensions of the conducting areas can cause the inductive and capacitive coupling between the resonators to be almost completely canceled, whereby there is formed an almost ideal electric "partition" between the resonators. This enables the circuit to operate as a band-stop filter having a defined stop-band. The bandwidth and the center frequency are determined by the circuit pattern made with the mask, and by the concentrated inductances and capacitances, so that it is possible to obtain a desired band-stop filter by varying these. When the circuit pattern has been applied and the components fastened, the side of the block is covered with a metallic protecting cover, so that a small gap is left between the cover and the side surface.

Figure 2:
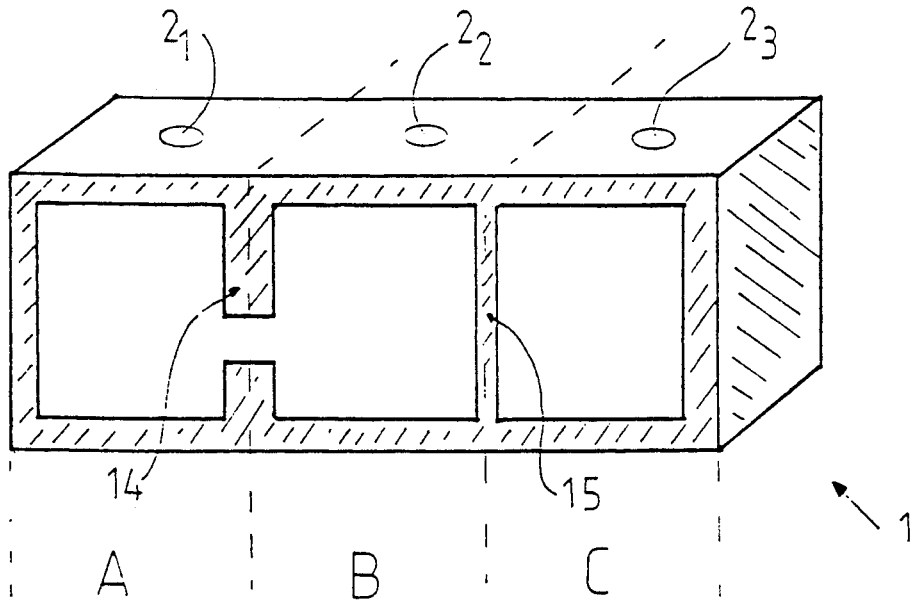
FIG. 2 shows in a simplified view the filter of FIG. 1, where the conducting areas have been modified.

For some purposes it may be necessary to decrease the isolation between the resonators. Then coupling may be provided between the resonators in a controlled way according to FIG. 2. In this figure the same reference numerals are used as in FIG. 1, but for simplicity the individual coupling means are omitted. The coupling between the resonators can be increased in that the conducting area between the resonators is shortened, as is made in the area 14 between the resonators A and B, or the conducting area is narrowed, as is made in the area 15 between the resonators B and C. It is also possible to use a combination of these. Depending on which end of the conducting area is shortened, this will have a different effect on the nature of the coupling between the resonators. Areas 14 and 15 are on one side surface of the filter. Area 14 is between resonators A and B and area 15 is between resonators B and C in the sense of being between locations on the one side surface which coincide with projections of the resonator holes on the one side surface.

Figure 3:
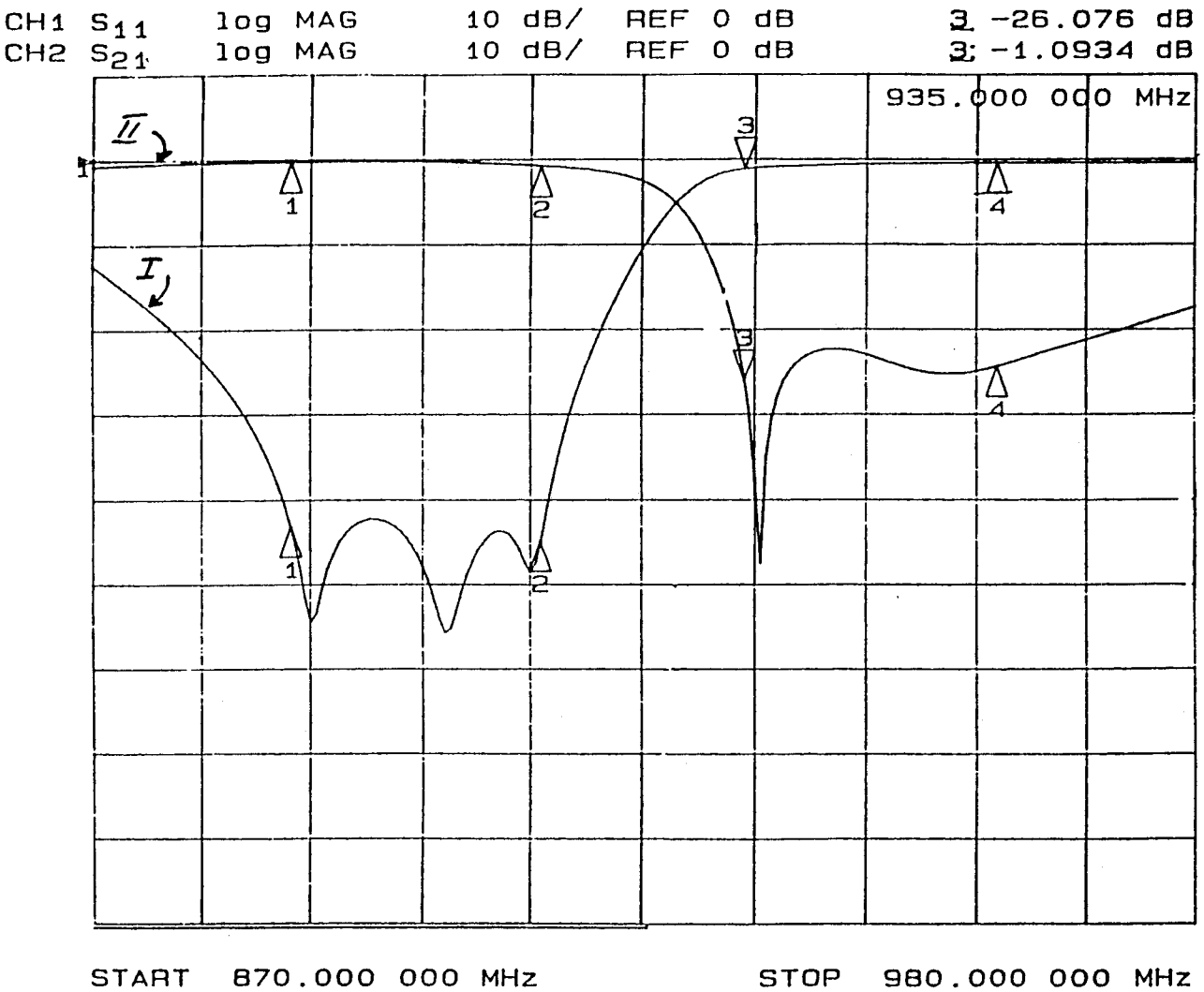
FIG. 3 shows the attenuation curve of the resonator in FIG. 1.

FIG. 3 shows the actual measured attenuation curve for a band-stop filter manufactured according to the invention in a single ceramic block. The realized filter is particularly intended to attenuate the frequency band 890–915 MHz, which is the transmission bandwidth of the GSM mobile phone system, the filter being suited e.g. for use in the receiving branch in connection with the antenna filter. The curve I, being an attenuation curve, shows that the attenuation is high, more than 40 dB between the markers 1 and 2 constituting said frequency band, and thereafter the attenuation rapidly approaches zero. This is advantageous in that the transmitter frequency will not reach the receiver. The curve II shows the matching of the filter.

When a conducting area according to the invention is used between the resonators, an "electrical partition" is obtained between the resonators. This entails many advantages. It is not necessary to assemble the band-stop filter from separate coated resonator blocks, but a single ceramic body may be used. This saves both processing steps and material. Because necessary circuits are made with a mask on the side of the ceramic body, the same body can be used for the manufacture of a band-stop filter and a band-pass filter, the band-pass filter being designed e.g. according to the Finnish patent applications FI-892855 and FI-892856. The characteristics of the band-stop filter are easily varied by changing the mask and component values.

We claim:

1. A band-stop filter, comprising;

a plurality of resonators, each of the resonators being composed of a portion of dielectric material having top, bottom and at least two side surfaces with a respective hole extending from said top surface to said bottom surface, the portion of dielectric material for each resonator being adjacent each other along dividing lines, the top, bottom and at least a first side surface being generally covered with an electrically conducting material, a second side surface being at most partially covered with electrically conductive material; and conductive strip means for substantially cancelling out electric and magnetic fields between said resonators, said conductive strip means including at least one conductive strip located at a respective one of the dividing lines on the second side surface and extending generally straightly between the conductive material on the top and bottom surfaces, said conductive strip being elongated in a direction parallel to a direction of elongation of the resonator hole.

2. A filter according to claim 1 characterized in that said at least one conductive strip is discontinuous, whereby the length of the discontinuity affects the coupling between adjacent resonators.

3. A filter according to claim 1, characterized in that said at least one conductive strip is narrower in width than necessary to cancel the electric and magnetic field between the resonators, whereby the width of the conductive strip affects the coupling between adjacent resonators.

4. A filter as in claim 1, wherein said portions of said dielectric material are parts of a single ceramic block.

5. A filter as in claim 1, further including filter circuit patterns and connecting means for connecting a signal to the filter circuit patterns and for coupling said signal to said resonators and for outputting a signal from the filter circuit patterns.

6. A filter according to claim 5, characterized in that the connecting means, the circuit patterns and the conductive strip means are located on the same side surface.

7. A filter as in claim 6, wherein the filter circuit patterns include isolated spots of conductive material on the same side surface, said isolated spots each being aligned generally with the mid point of the hole of an associated one of the resonators, the circuit patterns also including surrounding conductive material located around the edges of the same side surface on which is located the conductive strip means, and capacitive elements connecting the spots and the surrounding conductive material.

8. A filter as in claim 7, wherein the connecting means include inductive elements connecting the spots, an input lead connected to one of the spots of an associated one of the resonators and an output lead connected to another of the spots associated with another of the resonators.

9. A ceramic band-stop filter, comprising;

a plurality of resonators each composed of a portion of dielectric material having top, bottom and at least two side surfaces with a respective hole extending from said top surface to said bottom surface, said top, bottom and at least a first of the side surfaces being at least partly covered with an electrically conducting material, a second of said side surfaces being at most partially covered with electrically conductive material and which has elongated top and bottom edges; and conductive strip means for affecting coupling between adjacent ones of said resonators, said second side surface having respective locations which coincide with projections of said holes onto said second side surface, said conductive strip means being located between and spaced from said respective locations, said conductive strip means including at least one conductive strip extending generally straightly from the top edge to the bottom edge of said second side surface and which is elongated in a direction perpendicular to a direction of elongation of said top and bottom edges, said conductive strip means having a discontinuity whose length affects the coupling between said adjacent resonators.

10. A filter as in claim 9, wherein said plurality of resonators comprise a single ceramic block element having filter circuit patterns and connecting means for connecting a signal to the filter circuit patterns, for coupling said signal to said resonators, and for outputting a signal from the filter circuit patterns.

11. A ceramic band-stop filter, comprising;

a plurality of resonators each composed of a portion of dielectric material having top, bottom and at least two side surfaces with a respective hole, extending from said top surface to said bottom surface, said top, bottom and at least a first of the side surfaces being at least partly covered with an electrically conducting material, a second of said side surfaces being at most partially covered with electrically conductive material and which has elongated top and bottom edges; and conductive strip means for affecting coupling between adjacent ones of said resonators, said second side surface having respective locations which coincide with projections of said holes onto said second side surface, said conductive strip means being arranged spaced from and between said respective locations, said conductive strip means including at least one conductive strip extending generally straightly from the top edge to the bottom edge and which is elongated in a direction perpendicular to a direction of elongation of said top and bottom edges, said conductive strip means including a conductive strip that has a width which affects the coupling between said adjacent resonators and being narrower than that necessary for cancelling an electric and magnetic field between said adjacent resonators.

12. A filter as in claim 11, wherein said plurality of resonators comprise a single ceramic block element having filter circuit patterns and connecting means for connecting a signal to the filter circuit patterns, for coupling said signal to said resonators, and for outputting a signal from the filter circuit patterns.

13. A ceramic band-stop filter, comprising;

a plurality of resonators each composed of a portion of dielectric material having top, bottom and at least two side surfaces with a respective hole extending from said top surface to said bottom surface, said top, bottom and at least a first of the side surfaces being at least partly covered with an electrically conducting material, a second of said side surfaces being at most partially covered with electrically conductive material and which has elongated top and bottom edges; and conductive strip means for substantially cancelling out electric and magnetic fields between said resonators, said second side surface having respective locations which coincide with projections of said holes onto said second side surface, said conductive strip means being located between and spaced from said respective locations, said conductive strip means including at least one conductive strip extending generally straightly from the top edge to the bottom edge of said second side surface and which is elongated in a direction perpendicular to a direction of elongation of said top and bottom edges, said conductive strip means having a discontinuity whose length affects the coupling between said adjacent resonators elongation of said top and bottom edges.

14. A filter as in claim 13, wherein said plurality of resonators comprise a single ceramic block element having filter circuit patterns and connecting means for connecting a signal to the filter circuit patterns, for coupling said signal to said resonators, and for outputting a signal from the filter circuit patterns.

* * * * *